US010923069B2

(12) United States Patent
Oh et al.

(10) Patent No.: US 10,923,069 B2
(45) Date of Patent: Feb. 16, 2021

(54) SOURCE DRIVE INTEGRATED CIRCUIT AND DISPLAY APPARATUS INCLUDING THE SAME

(71) Applicant: SILICON WORKS CO., LTD., Daejeon (KR)

(72) Inventors: Myeong Woo Oh, Daejeon (KR); Cheol Woong Lee, Daejeon (KR); Jae Sup Han, Daejeon (KR); Hee Ju Kwak, Daejeon (KR); Kyu Hyeong Lee, Daejeon (KR)

(73) Assignee: SILICON WORKS CO., LTD., Daejeon (KR)

( * ) Notice: Subject to any disclaimer, the term of this patent is extended or adjusted under 35 U.S.C. 154(b) by 29 days.

(21) Appl. No.: 16/513,181

(22) Filed: Jul. 16, 2019

(65) Prior Publication Data

US 2020/0027419 A1 Jan. 23, 2020

(30) Foreign Application Priority Data

Jul. 20, 2018 (KR) ..... 10-2018-0084719

(51) Int. Cl.
*G09G 3/36* (2006.01)
*G09G 3/3233* (2016.01)

(52) U.S. Cl.
CPC ..... *G09G 3/3696* (2013.01); *G09G 3/3233* (2013.01); *G09G 2310/027* (2013.01); *G09G 2310/0289* (2013.01); *G09G 2320/0276* (2013.01)

(58) Field of Classification Search
CPC ..... G09G 3/3696; G09G 3/3233; G09G 2310/027
See application file for complete search history.

(56) References Cited

FOREIGN PATENT DOCUMENTS

| | | | |
|---|---|---|---|
| JP | 4650291 | B2 | 3/2011 |
| JP | 4748963 | B2 | 8/2011 |
| KR | 10-2016-0126765 | A | 11/2016 |

*Primary Examiner* — Kent W Chang
*Assistant Examiner* — Chayce R Bibbee
(74) *Attorney, Agent, or Firm* — Harness, Dickey & Pierce, P.L.C.

(57) ABSTRACT

Disclosed is a source drive integrated circuit comprising: a core unit, a channel processing unit provided in each of a channel area disposed in a first side of the control area and a channel area disposed in a second side of the control area facing the first side to convert digital data, corresponding to a digital image signal transferred from the core unit, into a data voltage corresponding to an analog image signal and to output the data voltage, a resistor string provided in at least one of a pad area disposed in a third side of the control area and a pad area disposed in a fourth side of the control area facing the third side to generate a gamma voltage for converting the digital data into the data voltage and to supply the gamma voltage to the channel processing unit, and N number of gamma pads.

20 Claims, 10 Drawing Sheets

SOURCE DRIVE INTEGRATED CIRCUIT AND DISPLAY APPARATUS INCLUDING THE SAME

CROSS-REFERENCE TO RELATED APPLICATIONS

This application claims the benefit of the Korean Patent Application No. 10-2018-0084719 filed on Jul. 20, 2018, which is hereby incorporated by reference as if fully set forth herein.

FIELD

The present disclosure relates to a source drive integrated circuit (IC).

BACKGROUND

With the advancement of information-oriented society, various requirements for display apparatuses for displaying an image are increasing. Various display apparatuses such as liquid crystal display (LCD) apparatuses and organic light emitting display apparatuses are being practically used as display apparatuses.

Display apparatuses each include a display panel, a gate driving circuit, and a data driving circuit. The display panel includes a plurality of pixels defined by a plurality of gate lines and a plurality of data lines. The gate driving circuit supplies a gate signal to the gate lines and the data driving circuit supplies data voltages to the data lines.

The data driving circuit includes a plurality of source drive integrated circuits (ICs). Each of the source drive ICs converts data, corresponding to a digital image signal received from a timing controller, into a data voltage corresponding to an analog image signal and outputs the data voltage to a corresponding data line.

FIG. 1 illustrates an internal configuration of a source drive IC. As illustrated in FIG. 1, the source drive IC 100 includes a core area 110 and a pad area 120. The core area 110 is an area where a plurality of circuit blocks 112 for operating the source drive IC 100 are provided. The pad area 120 is an area where a plurality of pads 122 which receive input signals from the outside to output a plurality of output signals, generated by the plurality of circuit blocks 112, to the outside are provided.

Generally, as illustrated in FIG. 1, the source drive IC 100 is implemented to have a rectangular shape where a length thereof in an X-axis direction is longer than a length thereof in a Y-axis direction, the core area 110 is disposed inside the source drive IC 100, and the pad area 120 is disposed outside the core area 110.

Recently, as miniaturization of the source drive IC 100 is required, it is required to decrease a size of the source drive IC 100 in the Y-axis direction or the X-axis direction, but since it is difficult to reduce a size of each of the circuit blocks 112 disposed in the core area 110, there is a limitation in decreasing a size of the source drive IC 100.

SUMMARY

Accordingly, the present disclosure is directed to providing a source drive integrated circuit (IC) and a display apparatus including the same that substantially obviate one or more problems due to limitations and disadvantages of the related art.

An aspect of the present disclosure is directed to providing a source drive IC with a reduced size and a display apparatus including the same.

Another aspect of the present disclosure is directed to providing a source drive IC, enabling the number of needed resistor strings to be reduced, and a display apparatus including the source drive IC.

Another aspect of the present disclosure is directed to providing a source drive IC, enabling a length of a gamma tap connecting a gamma pad to a resistor string to be reduced, and a display apparatus including the source drive IC.

The objects of the present disclosure are not limited to the aforesaid, but other objects not described herein will be clearly understood by those skilled in the art from descriptions below.

Additional advantages and features of the disclosure will be set forth in part in the description which follows and in part will become apparent to those having ordinary skill in the art upon examination of the following or may be learned from practice of the disclosure. The objectives and other advantages of the disclosure may be realized and attained by the structure particularly pointed out in the written description and claims hereof as well as the appended drawings.

To achieve these and other advantages and in accordance with the purpose of the disclosure, as embodied and broadly described herein, there is provided a source drive IC including a core unit provided in a control area, a channel processing unit provided in each of a channel area disposed in a first side of the control area and a channel area disposed in a second side of the control area facing the first side to convert digital data, corresponding to a digital image signal transferred from the core unit, into a data voltage corresponding to an analog image signal and to output the data voltage, a resistor string provided in at least one of a pad area disposed in a third side of the control area and a pad area disposed in a fourth side of the control area facing the third side to generate a gamma voltage for converting the digital data into the data voltage and to supply the gamma voltage to the channel processing unit, and N (where N is a natural number more than one) number of gamma pads provided in the at least one pad area to supply the resistor string with a gamma reference voltage for generating the gamma voltage.

In another aspect of the present disclosure, there is provided a display apparatus including a display panel including a plurality of gate lines and a plurality of data line, which are arranged to intersect one another and thereby define a plurality of pixel areas, and a pixel provided in each of the plurality of pixel areas, a gate driver supplying a gate signal to the plurality of gate lines, and a data driver supplying data voltages to the plurality of data lines, wherein the data driver includes the source drive IC comprising a core unit provided in a control area, a channel processing unit provided in each of a first channel area disposed in a first side of the control area and a second channel area disposed in a second side of the control area facing the first side to convert digital data, corresponding to a digital image signal transferred from the core unit, into a data voltage corresponding to an analog image signal and to output the data voltage, a resistor string provided in at least one of a first pad area disposed in a third side of the control area and a second pad area disposed in a fourth side of the control area facing the third side to generate a gamma voltage for converting the digital data into the data voltage and to supply the gamma voltage to the channel processing unit, and N (where N is a natural number more than one) number of gamma pads provided in the at least one of the first and second pad areas to supply the resistor string with a gamma reference voltage for generating the gamma voltage.

It is to be understood that both the foregoing general description and the following detailed description of the present disclosure are exemplary and explanatory and are intended to provide further explanation of the disclosure as claimed.

BRIEF DESCRIPTION OF THE DRAWINGS

The accompanying drawings, which are included to provide a further understanding of the disclosure and are incorporated in and constitute a part of this application, illustrate embodiments of the disclosure and together with the description serve to explain the principle of the disclosure. In the drawings.

DETAILED DESCRIPTION

Figure 1:
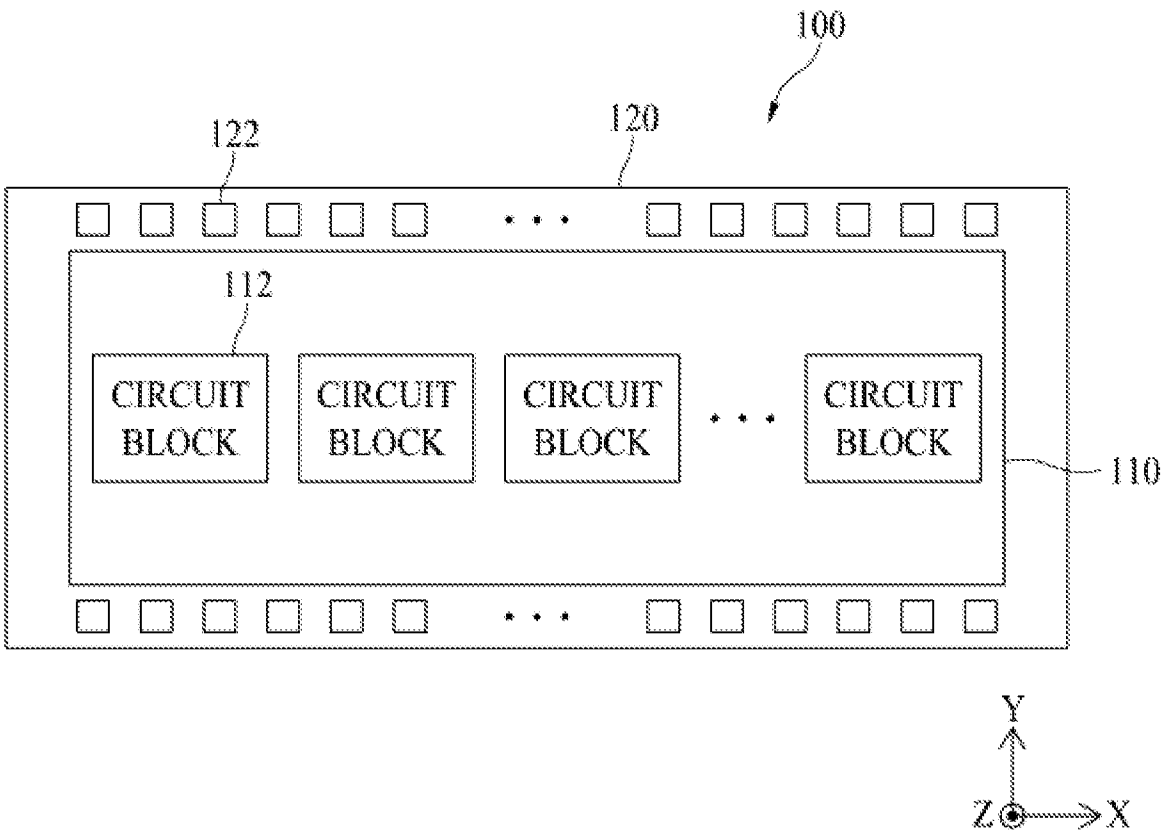
FIG. 1 is a diagram illustrating an internal configuration of a source drive IC.

In the specification, it should be noted that like reference numerals already used to denote like elements in other drawings are used for elements wherever possible. In the following description, when a function and a configuration known to those skilled in the art are irrelevant to the essential configuration of the present disclosure, their detailed descriptions will be omitted. The terms described in the specification should be understood as follows.

Advantages and features of the present disclosure, and implementation methods thereof will be clarified through following embodiments described with reference to the accompanying drawings. The present disclosure may, however, be embodied in different forms and should not be construed as limited to the embodiments set forth herein. Rather, these embodiments are provided so that this disclosure will be thorough and complete, and will fully convey the scope of the present disclosure to those skilled in the art. Further, the present disclosure is only defined by scopes of claims.

A shape, a size, a ratio, an angle, and a number disclosed in the drawings for describing embodiments of the present disclosure are merely an example, and thus, the present disclosure is not limited to the illustrated details. Like reference numerals refer to like elements throughout. In the following description, when the detailed description of the relevant known function or configuration is determined to unnecessarily obscure the important point of the present disclosure, the detailed description will be omitted.

In a case where 'comprise', 'have', and 'include' described in the present specification are used, another part may be added unless 'only' is used. The terms of a singular form may include plural forms unless referred to the contrary.

In construing an element, the element is construed as including an error range although there is no explicit description.

In describing a position relationship, for example, when a position relation between two parts is described as 'on~', 'over~', 'under~', and 'next~', one or more other parts may be disposed between the two parts unless 'just' or 'direct' is used.

In describing a time relationship, for example, when the temporal order is described as 'after~', 'subsequent~', 'next~', and 'before~', a case which is not continuous may be included unless 'just' or 'direct' is used.

It will be understood that, although the terms "first", "second", etc. may be used herein to describe various elements, these elements should not be limited by these terms. These terms are only used to distinguish one element from another. For example, a first element could be termed a second element, and, similarly, a second element could be termed a first element, without departing from the scope of the present disclosure.

An X axis direction, a Y axis direction, and a Z axis direction should not be construed as only a geometric relationship where a relationship therebetween is vertical, and may denote having a broader directionality within a scope where elements of the present disclosure operate functionally.

The term "at least one" should be understood as including any and all combinations of one or more of the associated listed items. For example, the meaning of "at least one of a first item, a second item, and a third item" denotes the combination of all items proposed from two or more of the first item, the second item, and the third item as well as the first item, the second item, or the third item.

Features of various embodiments of the present disclosure may be partially or overall coupled to or combined with each other, and may be variously inter-operated with each other and driven technically as those skilled in the art can sufficiently understand. The embodiments of the present disclosure may be carried out independently from each other, or may be carried out together in co-dependent relationship.

Hereinafter, exemplary embodiments of the present disclosure will be described in detail with reference to the accompanying drawings.

Figure 2:
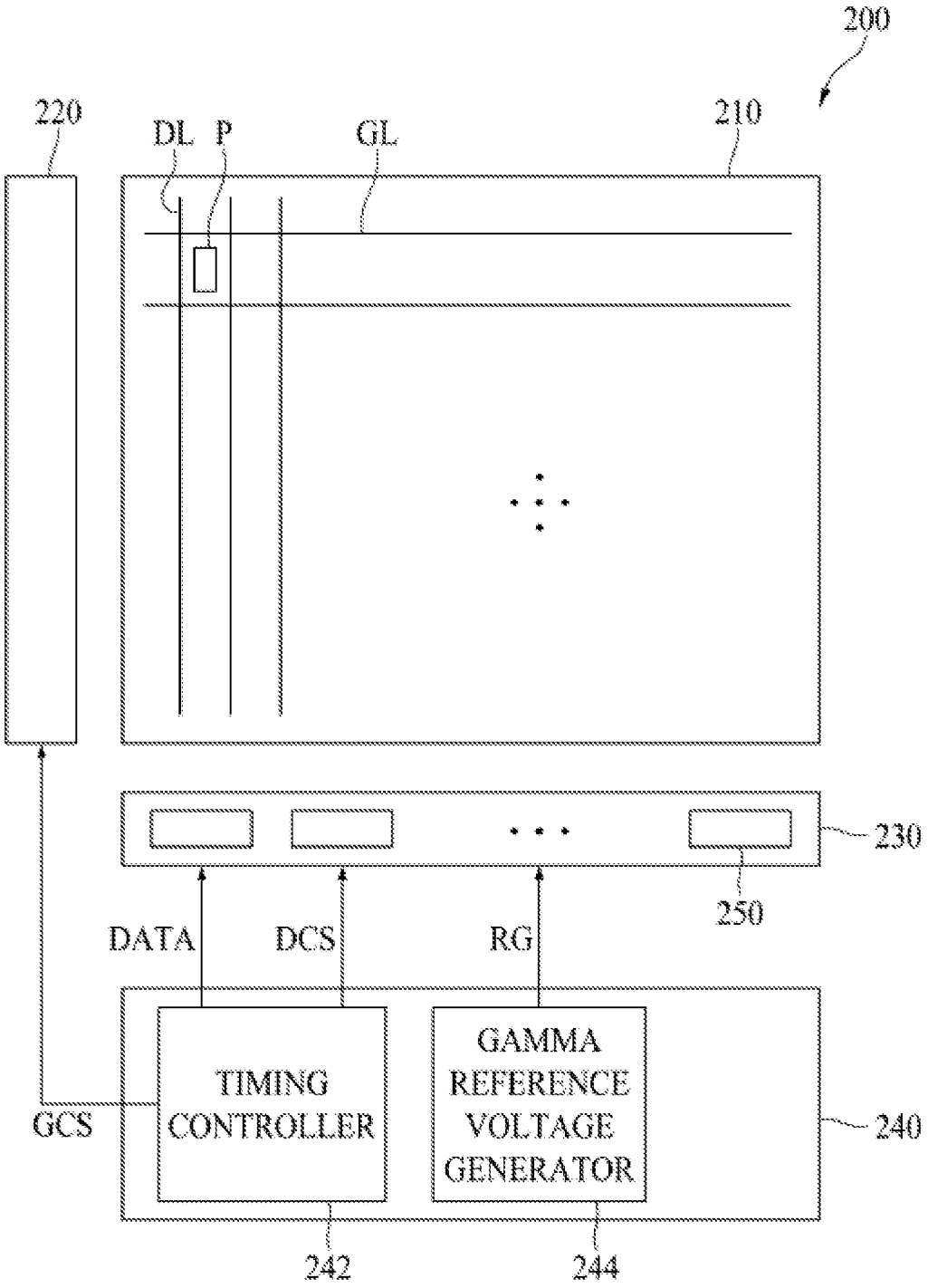
FIG. 2 is a diagram illustrating a configuration of a display apparatus according to an embodiment of the present disclosure.

FIG. 2 is a diagram illustrating a configuration of a display apparatus according to an embodiment of the present disclosure. As illustrated in FIG. 2, the display apparatus 200 may include a display panel 210, a gate driver 220, a data driver 230, and a printed circuit board (PCB) 240.

The display panel 210 may include a plurality of gate lines GL and a plurality of data lines DL, which are arranged to intersect one another and thereby define a plurality of pixel areas, and a pixel P provided in each of the plurality of pixel areas. The plurality of gate lines GL may be arranged in a widthwise direction and the plurality of data lines DL may be arranged in a lengthwise direction, but the present disclosure is not limited thereto. The display panel 210 may be implemented as various display panels, known to those skilled in the art, such as a liquid crystal display panel and an organic light emitting display panel.

The gate driver 220 may sequentially supply the gate signal having an on voltage or an off voltage to the plurality of gate lines GL. The gate driver 220, as illustrated, may be disposed in one side (for example, a left side) of the display panel 210, but depending on the case, may be disposed in all of the one side and the other side (for example, the left side and a right side), facing each other, of the display panel 210. The gate driver 220 may include a plurality of gate drive integrated circuits (ICs) (not shown). The gate driver 220 may be implemented as a tape carrier package (TCP) type with the gate drive ICs mounted thereon. In another embodiment, the gate drive ICs may be directly mounted on the display panel 210.

The data driver 230 may receive digital data DATA corresponding to a digital image signal from a timing controller 232 mounted on the PCB 240. The data driver 230 may convert the received digital data DATA into a data voltage corresponding to an analog image signal (i.e., an analog voltage) to output the data voltage to a corresponding data line of the plurality of data lines DL. The data driver 230, as illustrated, may be disposed in one side (for example, a lower side) of the display panel 210, but depending on the case, may be disposed in all of the one side and the other side (for example, the lower side and an upper side), facing each other, of the display panel 210. The data driver 230 may include a plurality of source drive ICs 250. The data driver 230 may be implemented as a TCP type with the source drive ICs 250 mounted thereon, but is not limited thereto.

In an embodiment, the source drive ICs 250 may each include a shift register, a latch, a digital-to-analog converter (DAC), and an output buffer. Also, each of the source drive ICs 250 may further include a level shifter which shifts a voltage level of the digital data DATA, corresponding to the digital image signal input from the timing controller 242, to a desired voltage level.

The timing controller 242 and a gamma reference voltage generator 244 may be provided on the PCB 240.

The timing controller 242 may supply a gate control signal GCS to the gate driver 220 to control the gate driver 220. In detail, the timing controller 242 may supply the gate control signal GCS including a gate start pulse (GSP), a gate shift clock (GSC), a gate output enable signal, and the like to the gate driver 220.

The timing controller 242 may supply the digital data DATA corresponding to the digital image signal and a data control signal DCS to the data driver 230 to control the data driver 230. In detail, the timing controller 242 may supply the data control signal DCS including a source start pulse (SSP), a source sampling clock (SSC), a source output enable signal, and the like to the data driver 230.

The gamma reference voltage generator 244 may include a plurality of resistors connected serially between a supply voltage source VDD and a ground voltage source GND. A plurality of gamma reference voltages RG having different voltage levels may be generated from nodes between the plurality of resistors. The plurality of gamma reference voltages RG generated by the gamma reference voltage generator 244 may be supplied to the data driver 230 (in more detail, the source drive ICs 250), and the source drive ICs 250 may generate a plurality of gamma voltages.

Figure 3:
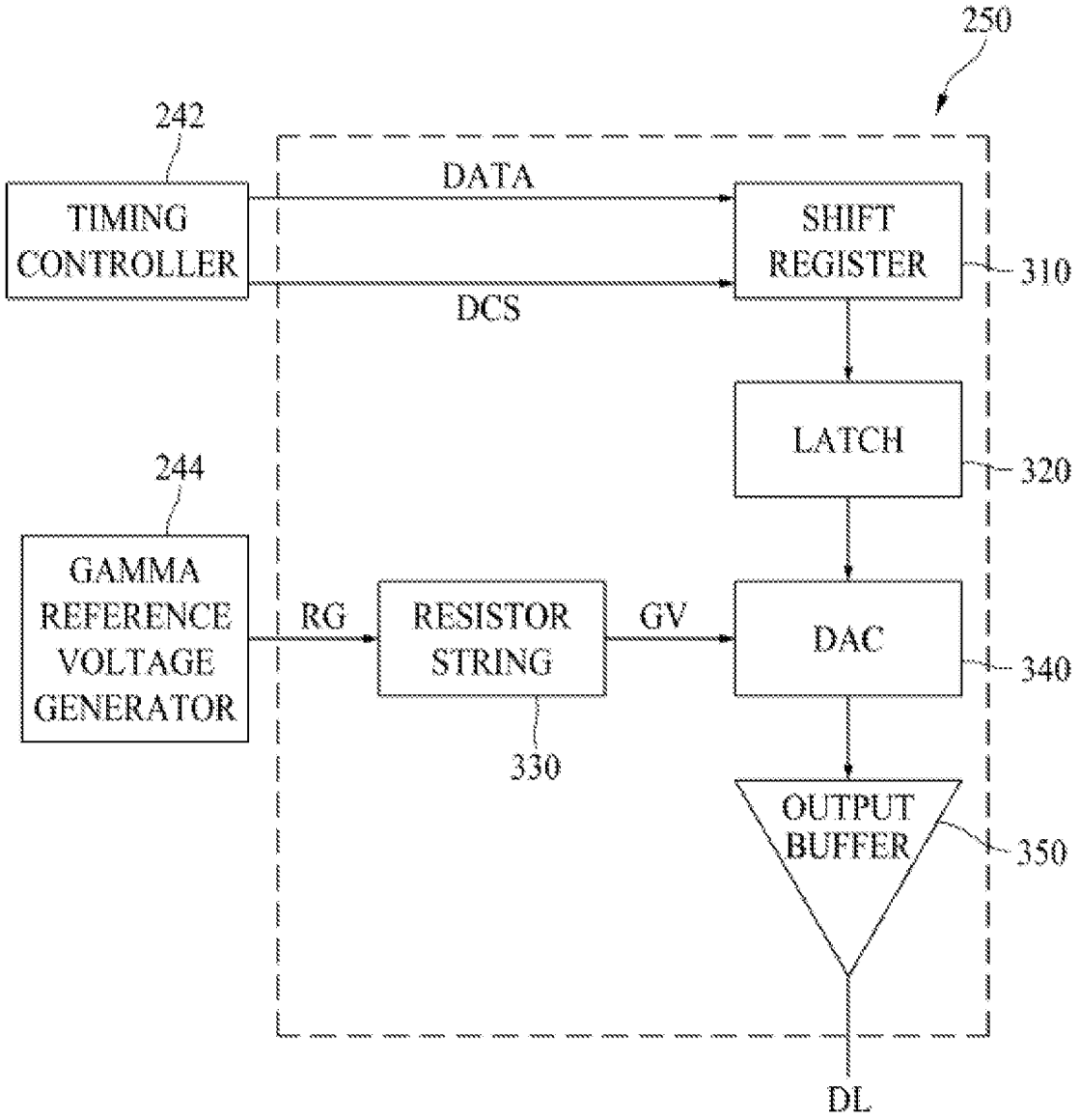
FIG. 3 is a block diagram of a source drive IC according to an embodiment of the present disclosure.

FIG. 3 is a block diagram of a source drive IC according to an embodiment of the present disclosure. In FIG. 3, a portion illustrated by a dotted line represents the source drive IC 250.

As illustrated in FIG. 3, the source drive IC 250 according to an embodiment of the present disclosure may include a shift register 310, a latch 320, a resistor string (R-string) 330, a DAC 340, and an output buffer 350.

The shift register 310 may sequentially shift the source start pulse (SSP) supplied from the timing controller 242 according to the source sampling clock (SSC) to generate and output a sampling signal.

The latch 320 may sequentially sample and latch, by units of certain data, the digital data DATA supplied from the timing controller 242 in response to the sampling signal from the shift register 310.

The resistor string 330 may generate a gamma voltage GV by using the gamma reference voltage RG generated by the gamma reference voltage generator 244 and may supply the generated gamma voltage GV to the DAC 340.

The DAC 340 may convert the digital data DATA from the latch 320 into a data voltage which is analog data, based on the gamma voltage GV generated by the resistor string 330.

The output buffer 350 may be serially connected to the data line DL of the display panel 200 illustrated in FIG. 2 and may buffer the data voltage from the DAC 340 to supply a buffered data voltage to the data line DL.

Figure 4:
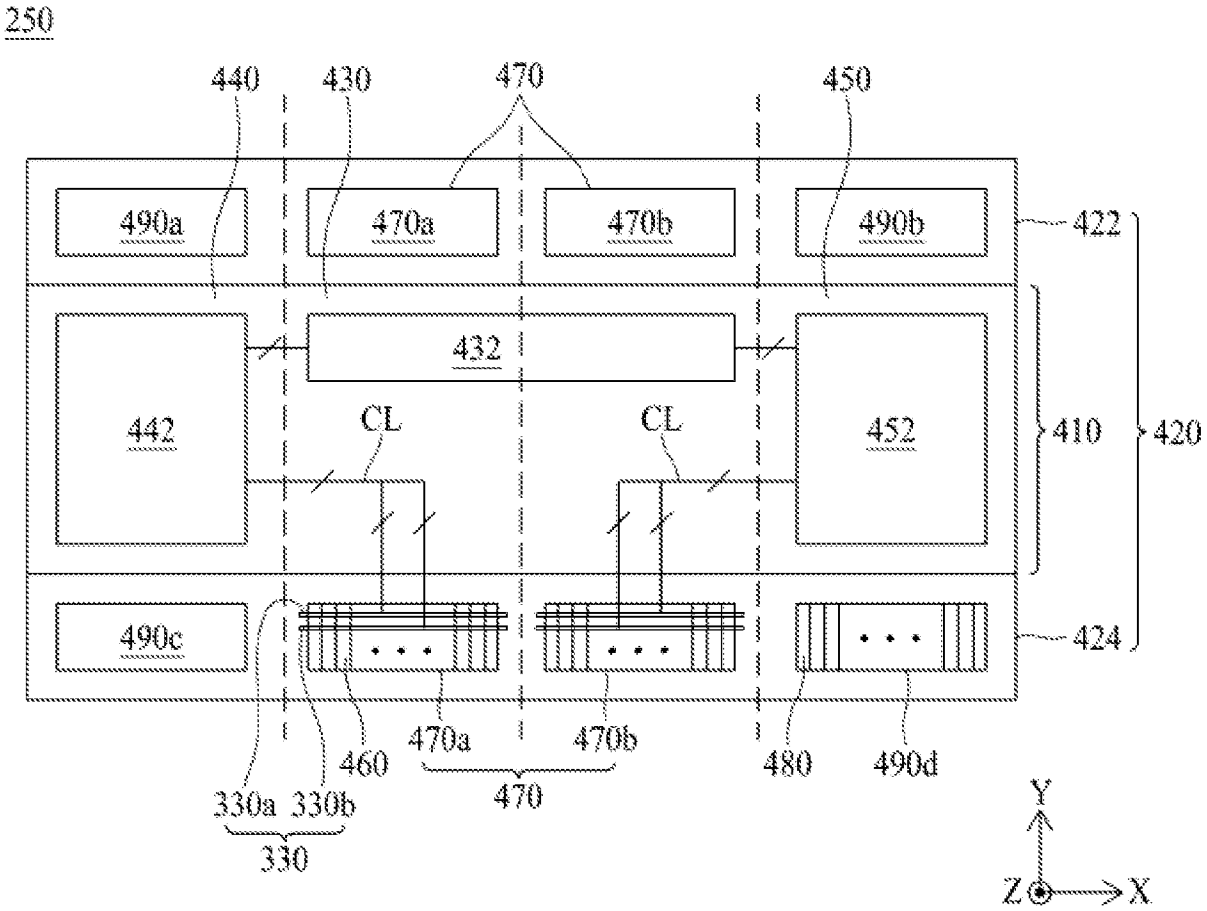
FIG. 4 is a diagram simply illustrating the arrangement of internal elements of a source drive IC according to an embodiment of the present disclosure.

FIG. 4 is a diagram simply illustrating the arrangement of internal elements of a source drive IC according to an embodiment of the present disclosure. As illustrated in FIG. 4, the source drive IC 250 may include a core area 410 and a pad area 420.

The core area 410 may be an area where a plurality of circuit blocks for driving the source drive IC 250 are provided. As illustrated in FIG. 4, the core area 410 may include a control area 430 disposed in a center thereof, a first channel area 440 disposed in one side of the control area 430, and a second channel area 450 disposed in the other side of the control area 430.

A core unit 432 may be provided in the control area 430, a first channel processing unit 442 may be provided in the first channel area 440, and a second channel processing unit 452 may be provided in the second channel area 450.

The core unit 432 may receive digital data DATA corresponding to a digital image signal from the timing controller 242 illustrated in FIG. 3 and may logic-process the received digital data DATA to transfer logic-processed digital data to the first and second channel processing units 442 and 452. In this case, the core unit 432 may receive the digital data DATA from the timing controller 242 through a plurality of input pads 460 of an input pad part 470 provided in the pad area 420. Also, the core unit 432 may receive feedback corresponding to reception of digital data from the first and second channel processing units 442 and 452.

The core unit 432 may include an interface (not shown) and a logic processing unit (not shown). The interface receives the digital data DATA. The logic processing unit logic-processes the received digital data DATA to transfer logic-processed digital data to the first and second channel processing units 442 and 452, and receives feedback from the first and second channel processing units 442 and 452.

In an embodiment, in a case where the source drive IC 250 outputs data voltages to $2n$ (where n is an integer equal to or more than one) number of data lines DL, the core unit 432 may transfer the digital data DATA to the first channel processing unit 442 including n channels of $2n$ number of channels and may transfer the digital data DATA to the second channel processing unit 452 including the other n channels.

The first channel processing unit 442 may include n number of left channels which receive digital data DATA from the core unit 432 to output data voltages corresponding to analog image signals. To this end, the first channel processing unit 442 may include a shift register 310, a latch 320, a resistor string 330, a DAC 340, and an output buffer 350 as illustrated in FIG. 3, which are each provided as an n number. That is, each of the n left channels may include the shift register 310, the latch 320, the resistor string 330, the DAC 340, and the output buffer 350, and a data voltage output through each of the n left channels may be supplied to a data line DL corresponding to a corresponding channel.

The second channel processing unit 452 may include n number of right channels which receive digital data DATA from the core unit 432 to output data voltages corresponding to analog image signals. To this end, the second channel processing unit 452 may include a shift register 310, a latch 320, a resistor string 330, a DAC 340, and an output buffer 350 as illustrated in FIG. 3, which are each provided as an n number. That is, each of the n right channels may include the shift register 310, the latch 320, the resistor string 330, the DAC 340, and the output buffer 350, and a data voltage output through each of the n right channels may be supplied to a data line DL corresponding to a corresponding channel.

The pad area 420 may include a first pad area 422 and a second pad area 424. The first pad area 422 may be disposed in an upper end of the core area 410, and the second pad area 424 may be disposed in a lower end of the core area 410. In FIG. 4, the pad area 420 is illustrated as including only the first and second pad areas 422 and 424, but this is merely an example. In other embodiments, the pad area 420 may further include a pad area (not shown) disposed to the left of the core area 410 and a pad area (not shown) disposed to the right of the core area 410.

The input pad part 470 including the plurality of input pads 460 may be disposed at a position, corresponding to the control area 430, of the first and second pad areas 422 and 424. A plurality of output pad part 490*a* to 490*d* each including a plurality of output pads 480 may be disposed at positions, corresponding to the channel areas 440 and 450, of the first and second pad areas 422 and 424. The input pad part 470 may be disposed in only one of the first and second pad areas 422 and 424, or may be disposed in all of the first and second pad areas 422 and 424. Hereinafter, for convenience of description, an example where the input pad part 470 is disposed in the second pad area 424 will be described.

The input pad part 470, as illustrated in FIG. 4, may include a first channel input pad part 470*a* and a second channel input pad part 470*b*. A configuration of the second channel input pad part 470*b* is the same as that of the first channel input pad part 470*a*. Hereinafter, therefore, a configuration of the input pad part 470 will be described with reference to the first channel input pad part 470*a*.

The first channel input pad part 470*a* may include a plurality of input pads 460. The plurality of input pads 460 may include N number of gamma pads GP1 to GPN. The N gamma pads GP1 to GPN may each denote an input pad 460 to which the plurality of gamma reference voltages RG generated by the gamma reference voltage generator 244 illustrated in FIG. 3 are applied.

Particularly, a resistor string 330 may be provided in the first channel input pad part 470*a* according to an embodiment of the present disclosure. That is, in general source drive ICs, since the resistor string 330 is provided in the core area 410, it is difficult to decrease a size of each source drive IC 250 due to a limitation of a layout. On the other hand, according to the present disclosure, since the resistor string 330 is provided in the first channel input pad part 470*a* provided in the pad area 420, a Y-axis size of each source drive IC 250 may be reduced.

The resistor string (R-string) 330 may be configured with a plurality of resistors serially connected to one another. The resistor string 330 may be supplied with the plurality of gamma reference voltages RG from the gamma reference voltage generator 244 illustrated in FIG. 3 to generate the plurality of gamma voltages GV and may supply the generated plurality of gamma voltages GV to the first channel processing unit 442. In detail, when the plurality of gamma reference voltages RG generated by the gamma reference voltage generator 244 are applied to the resistor string 330 through a plurality of gamma pads GP1 to GPN, the applied voltages may be divided through the plurality of resistors of the resistor string 330, and thus, the plurality of gamma voltages GV corresponding to gray voltages may be generated at each node. At this time, the gamma reference voltages RG may be applied to both ends of the resistor string 330 and a plurality of middle points therebetween.

Figure 5:
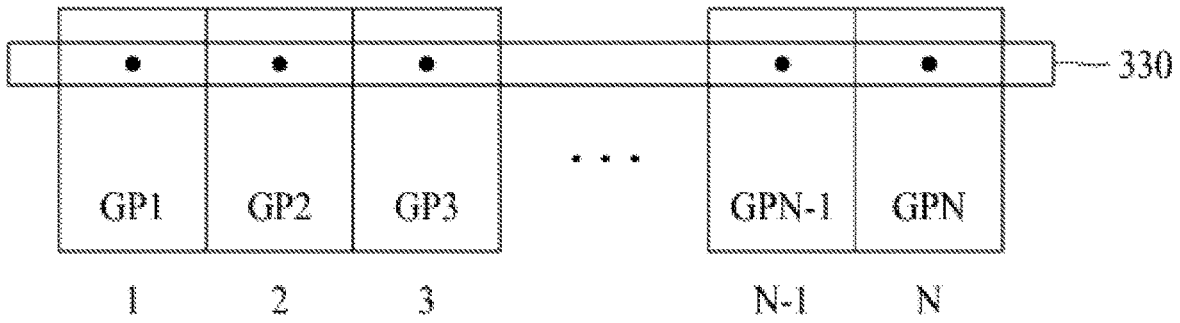
FIG. 5 is a diagram illustrating an arrangement method of gamma pads based on the number of resistor strings according to an embodiment of the present disclosure.

The resistor string 330 may be connected to the plurality of gamma pads GP1 to GPN through a gamma pad (not shown) so as to receive the plurality of gamma reference voltages RG. To this end, as illustrated in FIG. 4, the resistor string 330 may be configured to extend in an X-axis direction. In this case, as illustrated in FIG. 5, the plurality of gamma pads GP1 to GPN may be sequentially arranged in the X-axis direction in ascending power of numbers of the gamma pads GP1 to GPN and may be connected to the resistor string 330.

As described above, according to the present disclosure, since the resistor string 330 is provided in the second pad area 244, a length of the gamma tap for connecting the gamma pads GP1 to GPN to the resistor string 330 may be reduced, thereby decreasing a resistance value due to the gamma tap.

Moreover, the resistor string 330 may be configured to extend in the X-axis direction in which the gamma pads GP1 to GPN are arranged, the number of needed resistor strings 330 may decrease, thereby reducing the design complexity of the source drive ICs 250 and enhancing a degree of freedom in designing of the source drive ICs 250.

Moreover, according to the above-described embodiment, a length of the gamma tap for connecting the gamma pads GP1 to GPN to the resistor string 330 may be constant regardless of each of the gamma pads GP1 to GPN, and thus, a resistance value deviation between gamma taps may be maintained to be constant.

In the above-described embodiment, each of the source drive ICs 250 has been described above as including one resistor string 330, but is not limited thereto and may include a plurality of resistor strings 330. For example, as illustrated in FIG. 4, the resistor string 330 may include a first resistor string 330*a* and a second resistor string 330*b*. In this case, the first resistor string 330*a* and the second resistor string 330*b* may be electrically connected to each other at one ends thereof. According to such an embodiment, some of the gamma pads GP1 to GPN may be connected to the first resistor string 330*a* through a gamma tap (not shown), and the other gamma pads may be connected to the second resistor string 330*b* through a gamma tap (not shown). In this case, the first resistor string 330*a* and the second resistor string 330*b* may be disposed apart from each other by a certain interval in the Y-axis direction to extend in the X-axis direction.

As described above, in a case where the resistor string 330 is implemented with the first resistor string 330*a* and the second resistor string 330*b*, a length of the resistor string 330 which extends in the X-axis direction so as to be connected to the gamma pads GP1 to GPN may be reduced, a size of each source drive IC 250 in the X-axis direction may decrease.

Moreover, according to the present disclosure, since all of the first resistor string 330*a* and the second resistor string 330*b* are provided in the second pad area 244, lengths of gamma taps for connecting the gamma pads GP1 to GPN to the first and second resistor strings 330*a* and 330*b* may be reduced, thereby decreasing a resistance value due to each of the gamma taps. Also, lengths of gamma taps of gamma pads connected to the first resistor string 330*a* may be the same, and lengths of gamma taps of gamma pads connected to the second resistor string 330*b* may be the same, thereby maintaining a resistance value deviation between gamma taps to be constant.

Figure 6:
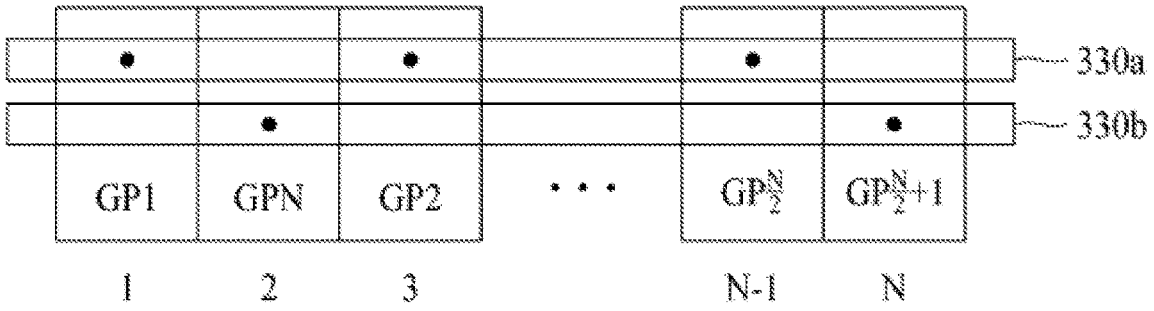
FIG. 6 is a diagram illustrating an arrangement method of gamma pads based on the number of resistor strings according to another embodiment of the present disclosure.

In a case where the resistor string 330 is configured with the first resistor string 330*a* and the second resistor string 330*b*, as illustrated in FIG. 6, first to $(N/2)^{th}$ gamma pads GP1 to GPN/2 may be connected to the first resistor string 330*a*, and $(N/2+1)^{th}$ to $N^{th}$ gamma pads GPN/2+1 to GPN may be connected to the second resistor string 330*b*. In this case, in the arrangement order of the gamma pads GP1 to GPN, the first to $(N/2)^{th}$ gamma pads GP1 to GPN/2 may be disposed at odd-numbered positions in ascending power of pad numbers, and the $(N/2+1)^{th}$ to $N^{th}$ gamma pads GPN/2+1 to GPN may be disposed at even-numbered positions in descending power of pad numbers.

Figure 7:
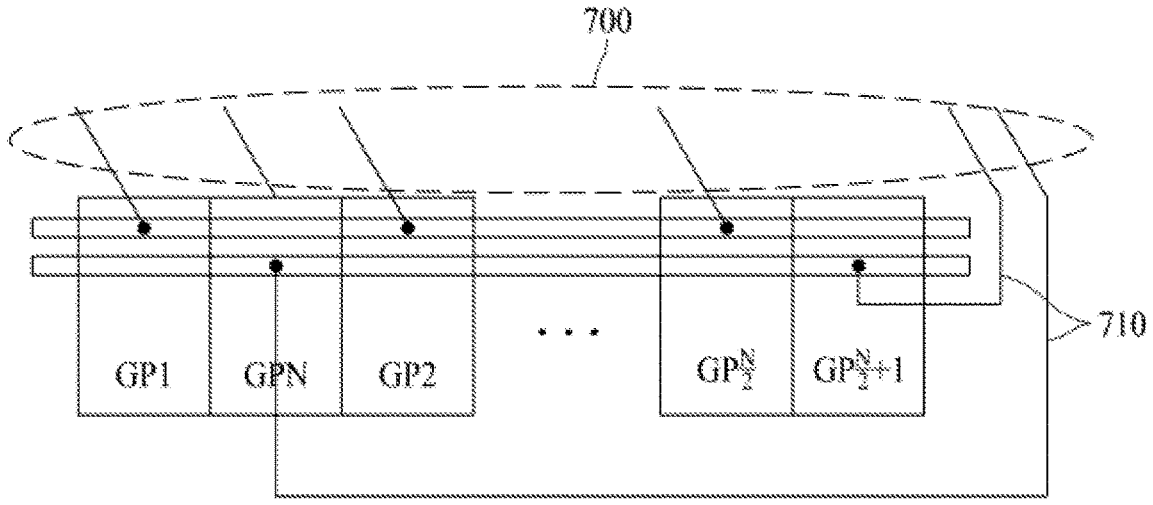
FIG. 7 is a diagram illustrating a connection between a voltage application line, a routing line, and a gamma pad according to an embodiment of the present disclosure.

In this case, as illustrated in FIG. 7, the first to $(N/2)^{th}$ gamma pads GP1 to GPN/2 connected to the first resistor string 330*a* may be supplied with the gamma reference voltage from the gamma reference voltage generator 244 through only the voltage application line 700, but the $(N/2+1)^{th}$ to $N^{th}$ gamma pads GPN/2+1 to GPN connected to the second resistor string 330*b* may be supplied with the gamma reference voltage from the gamma reference voltage generator 244 through the voltage application line 700 and the routing line 710.

The resistor string 330 may supply the generated plurality of gamma voltages GV to the first channel processing unit 442. To this end, each of the source drive ICs 250 according to the present disclosure may further include a connection line CL for connecting the resistor string 330 to the first channel processing unit 442. For convenience of description, in FIG. 4, only one connection line CL is illustrated, but the connection line CL may be provided in plurality corresponding to the number of gamma voltages GV generated by the resistor string 330.

In an embodiment, at least some of the plurality of connection lines CL may be provided in the second pad area 424, and the other connection lines CL may be provided in the core area 410. According to such an embodiment, since at least some of the plurality of connection lines CL are provided in the second pad area 424, a size of each source drive IC 250 in the Y-axis direction may be more reduced.

Hereinafter, a configuration of the input pad part 470 including the resistor string 330 according to the present disclosure will be described in more detail with reference to FIGS. 8 and 9. Hereinafter, for convenience of description, an example where the resistor string 330 includes the first and second resistor strings 330*a* and 330*b* will be described. However, as described above, the resistor string 330 may be implemented with only one resistor string, or may be implemented with three or more resistor strings.

Figure 8:
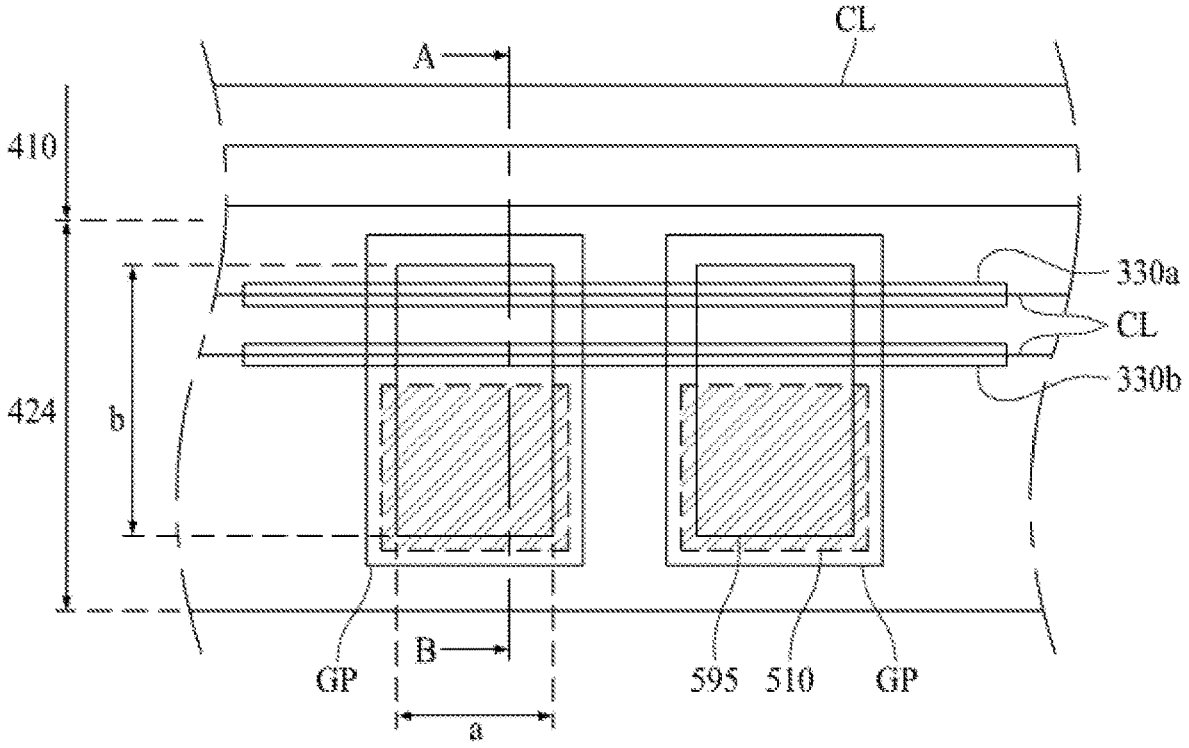
FIG. 8 is a partially enlarged view of an input pad part including a resistor string.
Figure 9:
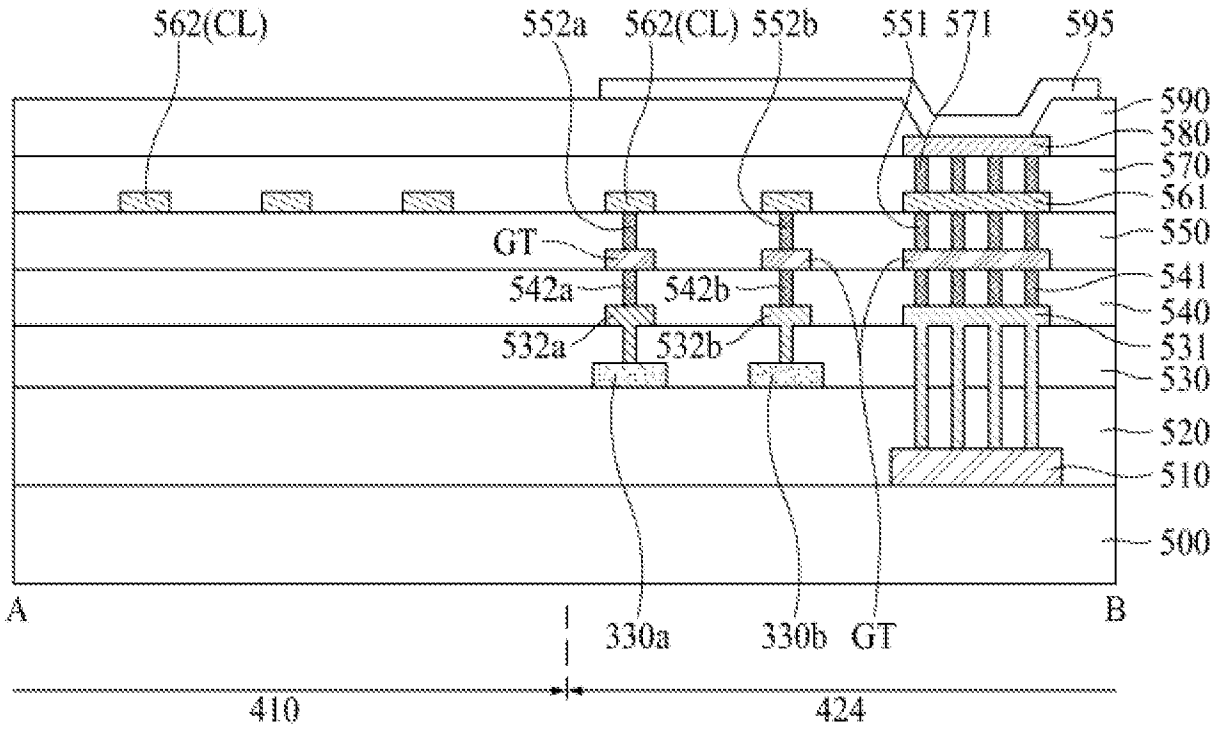
FIG. 9 is a cross-sectional view taken along line A-B of FIG. 8.

FIG. 8 is a partially enlarged view of an input pad part including a resistor string, and FIG. 9 is a cross-sectional view taken along line A-B of FIG. 8. In FIG. 8, for convenience of description, only two gamma pads GP are illustrated.

As illustrated in FIGS. 8 and 9, a diode 510 may be provided in the input pad part 470 provided in the second pad area 424 on a substrate 500. The diode 510 may prevent static electricity from occurring in each of the gamma pads GP1 to GPN and may be provided under the gamma pads GP1 to GPN.

A first insulation layer 520 may be provided on the diode 510, and first and second resistor strings 330*a* and 330*b* may be provided on the first insulation layer 520. In an embodiment, the first and second resistor strings 330*a* and 330*b* may be provided in a region, which does not overlap the diode 510, on the first insulation layer 520 in the second pad area 424. According to the present disclosure, a region, where the diode 510 is provided, of the second pad area 424 may be reduced and the first and second resistor strings 330*a* and 330*b* may be provided in the other region except the region where the diode 510 is provided, and thus, the first and second resistor strings 330*a* and 330*b* may be removed from the control area 430, thereby decreasing a size of the control area 430 in the Y-axis direction.

A second insulation layer 530 may be provided on the first and second resistor strings 330*a* and 330*b*. A plurality of first conductive layers 531, 532*a*, and 532*b* may be provided on the second insulation layer 530. The first conductive layers 531, 532*a*, and 532*b* may include a first contact electrode 531, a second contact electrode 532*a*, and a third contact electrode 532*b*. The first contact electrode 531 may be connected to the diode 510 through a plurality of contact holes provided in the first and second insulation layers 520 and 530, the second contact electrode 532*a* may be connected to the first resistor string 330*a* through a contact hole provided in the second insulation layer 530, and the third contact electrode 532*b* may be connected to the second resistor string 330*b* through a contact hole provided in the second insulation layer 530.

A third insulation layer 540 may be provided on the first conductive layers 531, 532*a*, and 532*b*, and a gamma tap GT may be provided as a second conductive layer on the third insulation layer 540. The gamma tap GT may be provided in plurality, and the plurality of gamma taps GT may be respectively connected to the first contact electrode 531, the second contact electrode 532*a*, and the third contact electrode 532*b* through a plurality of first contact layers 541, 542*a*, and 542*b* provided in the third insulation layer 540. The first contact layers 541, 542*a*, and 542*b* may include a first via 541, a second via 542*a*, and a third via 542*b*. The first via 541 may connect some of the gamma taps GT to the first contact electrode 531, the second via 542*a* may connect other some of the gamma taps GT to the second contact electrode 532*a*, and the third via 542*b* may connect the other some of the gamma taps GT to the third contact electrode 532*b*. An example where the first via 541 is provided in plurality and each of the second and third vias 542*a* and 542*b* is provided as one is illustrated, but the present disclosure is not limited thereto.

A fourth insulation layer 550 may be provided on the gamma taps GT, and a plurality of third conductive layers 561 and 562 may be provided on the fourth insulation layer 550. The third conductive layers 561 and 562 may include a fourth contact electrode 561 and a plurality of fifth contact electrodes 562. In this case, the fifth contact electrodes 562 may act as connection lines CL which connect the resistor strings 330*a* and 330*b* to the first channel processing unit 442.

In detail, the fourth contact electrode 561 and the fifth contact electrodes 562 may be connected to the gamma taps GT through a plurality of second contact layers 551, 552*a*, and 552*b* provided in the fourth insulation layer 550. The second contact layers 551, 552*a*, and 552*b* may include a fourth via 551, a fifth via 552*a*, and a sixth via 552*b*. The fourth via 551 may connect some of the gamma taps GT to the fourth contact electrode 561, the fifth via 552*a* may connect other some of the gamma taps GT to one of the fifth contact electrodes 562, and the sixth via 552*b* may connect the other some of the gamma taps GT to the other of the fifth contact electrodes 562.

One of the fifth contact electrodes 562 may be connected to the first resistor string 330*a* through a connection between the fifth via 552*a* and a corresponding gamma tap GT, and the other of the fifth contact electrodes 562 may be connected to the second resistor string 330*b* through a connection between the sixth via 552*b* and a corresponding gamma tap GT.

A fifth insulation layer 560 may be provided on the third conductive layers 561 and 562, and a sixth contact electrode 580 may be provided as a fourth conductive layer on the fifth insulation layer 560. The sixth contact electrode 580 may be connected to the fourth contact electrode 561 through a seventh via 571 which is a third contact layer provided in the fifth insulation layer 560.

A sixth insulation layer 590 may be provided on the sixth contact electrode 580, and a bump 595 may be provided in the sixth insulation layer 590. The bump 595 may be connected to the sixth contact electrode 580 through a contact hole provided in the sixth insulation layer 590.

As described above, according to an embodiment of the present disclosure, the diode 510, the first and second resistor strings 330*a* and 330*b*, the second and third contact electrodes 532*a* and 532*b*, the second and third vias 542*a* and 542*b*, the gamma taps T, the fifth and sixth vias 552*a* and 552*b*, and the fifth contact electrode 562 may be sequentially stacked in the second pad area 424, and the seventh via 571, the sixth contact electrode 580, and the bump 595 may be sequentially stacked on the fifth insulation layer 560 including the fifth contact electrode 562, whereby the first and second resistor strings 530*a* and 530*b* may be provided in the second pad area 424. Accordingly, a size of each source drive IC 250 may be reduced.

Figure 10A:
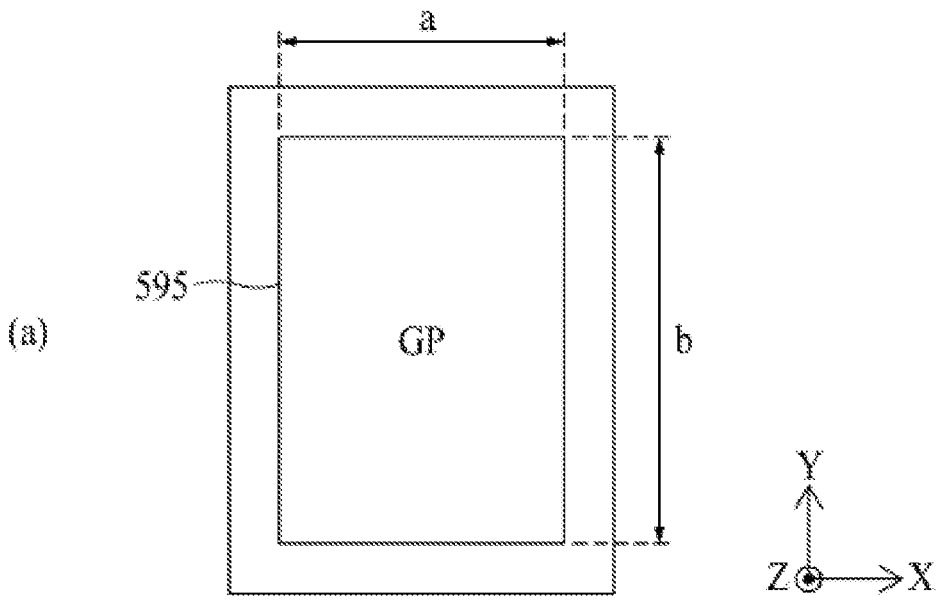
FIGS. 10A, 10B, 11A and 11B are diagrams illustrating a shape of a bump according to various embodiments of the present disclosure.
Figure 10B:
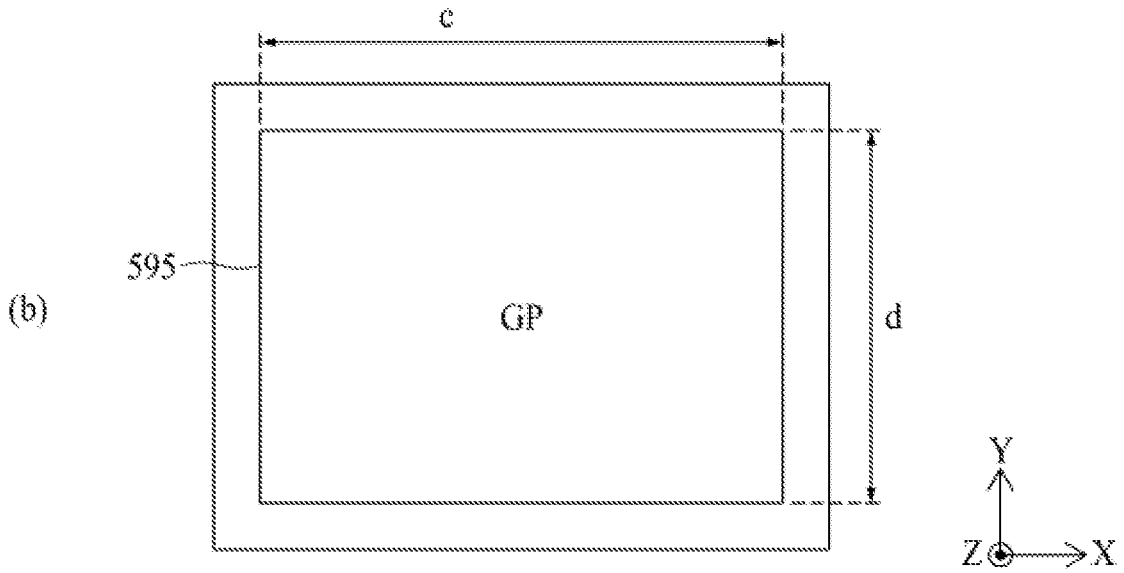

In the above-described embodiments, as illustrated in FIG. 10A, it has been described that a Y-axis length b of the bump 595 included in the gamma pad GP is longer than an X-axis length a of the bump 595. However, in a modified embodiment, as illustrated in FIG. 10B, the gamma pad GP may be implemented to include a bump 595 where an X-axis length c thereof is longer than a Y-axis length d thereof. In this case, the X-axis length c of the bump 595 illustrated in FIG. 10B may be approximately twice the X-axis length a of the bump 595 illustrated in FIG. 10A.

Figure 11A:
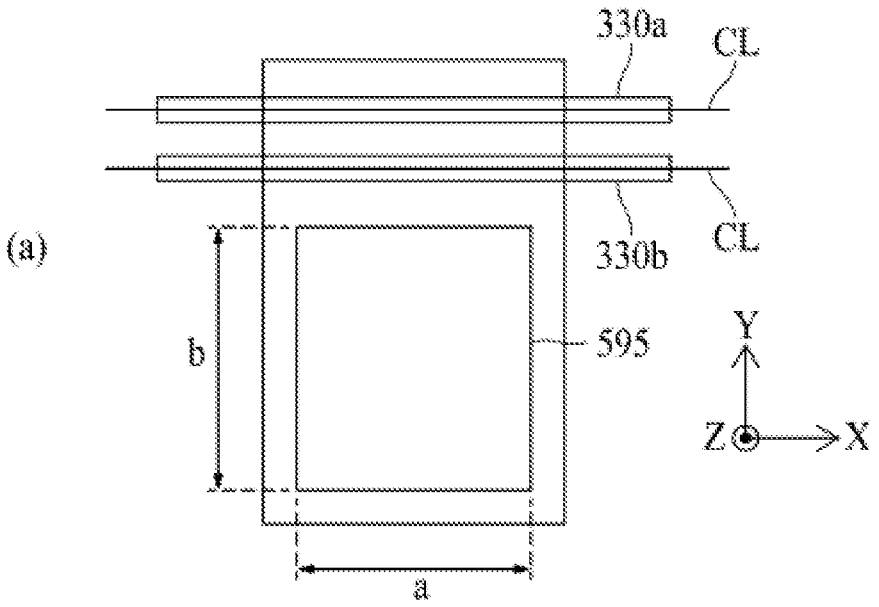
Figure 11B:
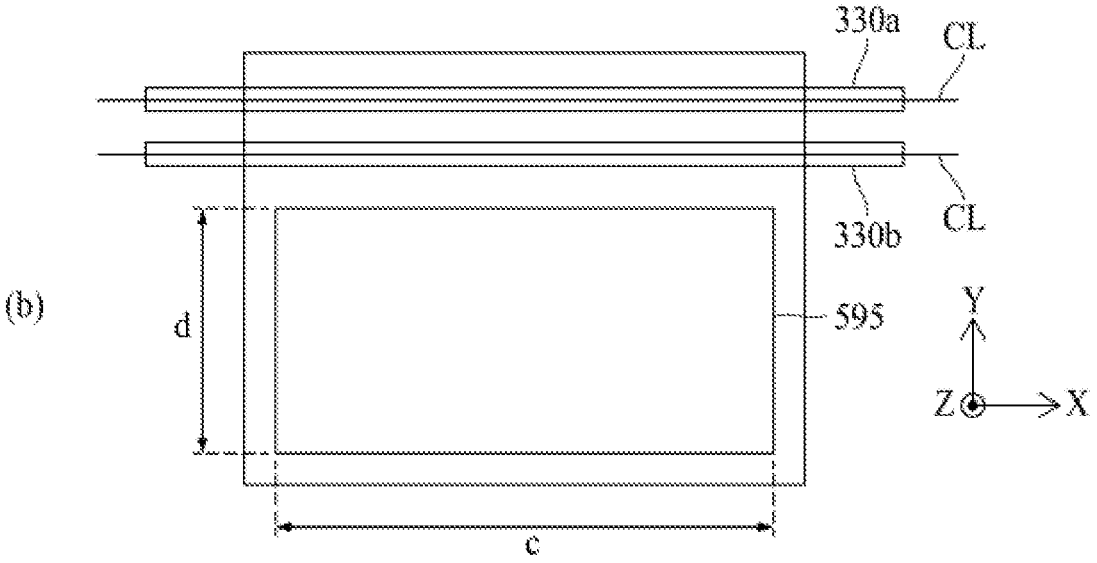

In another embodiment, the bump 595 of the gamma pad GP may not be provided to cover a whole area of the gamma pad GP as illustrated in FIGS. 10A and 10B but may be provided to cover only a region, which does not overlap the resistor strings 330*a* and 330*b*, of an area of the gamma pad GP as illustrated in FIGS. 11A and 11B. Accordingly, the use of the expensive bump 595 may decrease, and thus, the manufacturing cost may be reduced.

In another embodiment, the bumps 595 of the gamma pads GP may be provided not to cover a whole area of the gamma pad GP, and in this case, the bumps 595 of the gamma pads GP disposed at odd-numbered positions may be provided in an area overlapping the resistor string 330 and the bumps 595 of the gamma pads GP disposed at even-numbered positions may be provided in an area which does not overlap the resistor string 330.

In the above-described embodiments, it has been described that the gamma pads GP are disposed adjacent to one another. However, in the modified embodiment, the gamma pads GP may be disposed apart from one another by a predetermined interval.

Figure 12A:
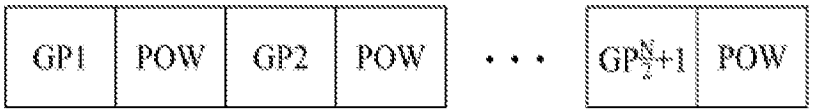
FIGS. 12A and 12B are diagrams illustrating an arrangement method of a gamma pad and a power pad.
Figure 12B:
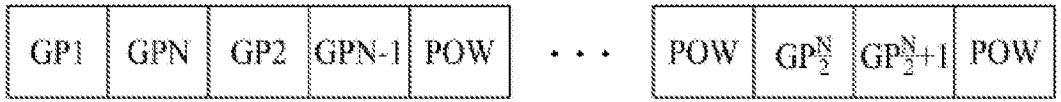

According to such an embodiment, as illustrated in FIG. 12A, when an input pad 460 further includes a plurality of power pads POW, the plurality of power pads POW and a plurality of gamma pads GP may be alternately arranged. In another embodiment, as illustrated in FIG. 12B, a predetermined number of gamma pads GP may be first disposed, at least some of a plurality of power pads POW may be subsequently disposed, and the other gamma pads GP and the other power pads POW may be subsequently disposed.

Referring again to FIG. 4, the output pads 480 may be provided in the output pad parts 490*a* to 490*d*. Each of the output pads 480 may output a data voltage, output from each of the first and second channel processing units 442 and 452, to a corresponding data line DL.

According to the present disclosure, the resistor string which is one element of the circuit blocks may be disposed in the pad area instead of the control area, and thus, a size of the source drive IC in the Y-axis direction may decrease, thereby reducing a total size of the source drive IC.

Moreover, according to the present disclosure, the number of resistor strings needed for generating a gamma voltage is reduced, thereby decreasing the design complexity and manufacturing cost of the source drive IC.

Moreover, according to the present disclosure, since a length of the gamma tap for connecting the gamma pad to the resistor string is shortened, a resistance value based on the gamma tap may decrease, a reduction in the design complexity of the source drive IC may be maximized, and a length of the gamma tap for each gamma pad may be maintained to be constant, thereby maintaining a resistance value deviation between the gamma taps to be constant.

The above-described feature, structure, and effect of the present disclosure are included in at least one embodiment of the present disclosure, but are not limited to only one embodiment. Furthermore, the feature, structure, and effect described in at least one embodiment of the present disclosure may be implemented through combination or modification of other embodiments by those skilled in the art. Therefore, content associated with the combination and modification should be construed as being within the scope of the present disclosure.

It will be apparent to those skilled in the art that various modifications and variations can be made in the present disclosure without departing from the spirit or scope of the disclosures. Thus, it is intended that the present disclosure covers the modifications and variations of this disclosure provided they come within the scope of the appended claims and their equivalents.

What is claimed is:

1. A source drive integrated circuit (IC) comprising:

a core unit provided in a control area;

a channel processing unit provided in each of a channel area disposed in a first side of the control area and a channel area disposed in a second side of the control area facing the first side to convert digital data, corresponding to a digital image signal transferred from the core unit, into a data voltage corresponding to an analog image signal and to output the data voltage;

a resistor string provided in at least one of a pad area disposed in a third side of the control area and a pad area disposed in a fourth side of the control area facing the third side to generate a gamma voltage for converting the digital data into the data voltage and to supply the gamma voltage to the channel processing unit; and N (where N is a natural number more than one) number of gamma pads provided in the at least one pad area to supply the resistor string with a gamma reference voltage for generating the gamma voltage.

2. The source drive IC of claim 1, wherein the resistor string is provided to extend in the same direction as a first direction in which the N gamma pads are arranged in the at least one pad area.

3. The source drive IC of claim 1, wherein each of the N gamma pads comprises a diode provided in a first region of the at least one pad area to prevent static electricity from occurring in a corresponding gamma pad, and the resistor string is provided in a second region, other than the first region, of the at least one pad area.

4. The source drive IC of claim 3, wherein the second region is disposed between the first region and the control area.

5. The source drive IC of claim 1, wherein the resistor string comprises:

a first resistor string connected to first to $(N/2)^{th}$ gamma pads of the N gamma pads; and a second resistor string electrically connected to the first resistor string and $(N/2+1)^{th}$ to $N^{th}$ gamma pads of the N gamma pads.

6. The source drive IC of claim 5, wherein the first and second resistor strings are provided to extend in the same direction as a first direction in which the N gamma pads are arranged in the at least one pad area, and the first and second resistor strings are disposed apart from each other by a certain interval in a second direction which is different from the first direction.

7. The source drive IC of claim 5, further comprising:

a plurality of first gamma taps connecting the first to $(N/2)^{th}$ gamma pads to the first resistor string; and a plurality of second gamma taps connecting the $(N/2+1)^{th}$ to $N^{th}$ gamma pads to the second resistor string, wherein the plurality of first gamma taps have the same length, and the plurality of second gamma taps have the same length.

8. The source drive IC of claim 5, wherein the first to $(N/2)^{th}$ gamma pads are sequentially disposed at odd-numbered positions in ascending power of pad numbers in the first direction, and the $(N/2+1)^{th}$ to $N^{th}$ gamma pads are sequentially disposed at even-numbered positions in descending power of pad numbers in the first direction.

9. The source drive IC of claim 5, further comprising:

a plurality of voltage application lines transferring the gamma reference voltage to the N gamma pads; and a routing line connecting some of the plurality of voltage application lines to the $(N/2+1)^{th}$ to $N^{th}$ gamma pads, wherein the gamma reference voltage is applied to the first to $(N/2)^{th}$ gamma pads through the plurality of voltage application lines, and the gamma reference voltage is applied to the $(N/2+1)^{th}$ to $N^{th}$ gamma pads through the plurality of voltage application lines and the routing line.

10. The source drive IC of claim 1, wherein the N gamma pads are sequentially disposed in ascending power of pad numbers in the first direction.

11. The source drive IC of claim 1, wherein each of the N gamma pads comprises:

a diode provided on a base substrate;

first to third metal layers sequentially stacked on the diode;

a contact provided on the third metal layer; and a bump provided on the contact, wherein the resistor string is provided in an area, which does not overlap the diode, between the diode and the first metal layer.

12. The source drive IC of claim 11, wherein a length of the bump in an X-axis direction is shorter than a length of the bump in a Y-axis direction.

13. The source drive IC of claim 11, wherein a length of the bump in an X-axis direction is equal to a length of the bump in a Y-axis direction.

14. The source drive IC of claim 11, wherein the bump is provided in an area which does not overlap the resistor string.

15. The source drive IC of claim 1, further comprising a plurality of power pads provided in the at least one pad area, wherein the plurality of power pads and the N gamma pads are alternately arranged in the at least one pad area.

16. The source drive IC of claim 1, further comprising a plurality of connection lines connecting the resistor string to the channel processing unit to apply the gamma voltage, generated by the resistor string, to the channel processing unit, wherein at least some of the plurality of connection lines are provided in the at least one pad area.

17. The source drive IC of claim 1, wherein the channel processing unit comprises a left channel processing unit provided in a left channel area disposed in the first side of the control area and a right channel processing unit provided in a right channel area disposed in the second side of the control area, and the resistor string comprises a left resistor string generating the gamma voltage to supply the gamma voltage to the left channel processing unit and a right resistor string generating the gamma voltage to supply the gamma voltage to the right channel processing unit.

18. A display apparatus comprising:

a display panel including a plurality of gate lines and a plurality of data lines, which are arranged to intersect one another and thereby define a plurality of pixel areas, and a pixel provided in each of the plurality of pixel areas;

a gate driver supplying a gate signal to the plurality of gate lines; and a data driver supplying data voltages to the plurality of data lines, wherein the data driver comprises the source drive IC comprising:

a core unit provided in a control area;

a channel processing unit provided in each of a first channel area disposed in a first side of the control area and a second channel area disposed in a second side of the control area facing the first side to convert digital data, corresponding to a digital image signal transferred from the core unit, into a data voltage corresponding to an analog image signal and to output the data voltage;

a resistor string provided in at least one of a first pad area disposed in a third side of the control area and a second pad area disposed in a fourth side of the control area facing the third side to generate a gamma voltage for converting the digital data into the data voltage and to supply the gamma voltage to the channel processing unit; and N (where N is a natural number more than one) number of gamma pads provided in the at least one of the first and second pad areas to supply the resistor string with a gamma reference voltage for generating the gamma voltage.

19. The display apparatus of claim 18, wherein each of the N gamma pads comprises a diode provided in a first region of the at least one of the first and second pad areas area to prevent static electricity from occurring in a corresponding gamma pad, and the resistor string is provided in a second region, other than the first region, of the at least one of the first and second pad areas.

20. The display apparatus of claim 18, wherein the resistor string comprises:

a first resistor string connected to first to $(N/2)^{th}$ gamma pads of the N gamma pads; and a second resistor string electrically connected to the first resistor string and $(N/2+1)^{th}$ to $N^{th}$ gamma pads of the N gamma pads.

* * * * *